United States Patent [19]

James et al.

[11] Patent Number: 5,003,447

[45] Date of Patent: Mar. 26, 1991

[54] LAMP REFLECTOR

[75] Inventors: Haydn James, Rugeley; David A. Birt, Cannock, both of England

[73] Assignee: Carello Lighting plc, United Kingdom

[21] Appl. No.: 480,688

[22] Filed: Feb. 15, 1990

[30] Foreign Application Priority Data

Feb. 18, 1989 [GB] United Kingdom ..... 8903738

[51] Int. Cl.[5] ..... F21V 7/06; F21V 5/02

[52] U.S. Cl. ..... 362/297; 362/339; 362/346

[58] Field of Search ..... 362/61, 297, 302, 346, 362/296, 298, 299, 341, 347, 339

[56] References Cited

U.S. PATENT DOCUMENTS

| | | | |
|---|---|---|---|
| 1,506,339 | 8/1924 | Giff | 362/350 |
| 3,688,149 | 8/1972 | Pitkjaan | 362/297 X |
| 4,149,229 | 4/1979 | Draper | 362/297X |
| 4,506,315 | 3/1985 | Maekawa et al. | 362/297 X |
| 4,566,056 | 1/1986 | Kouchi et al. | 362/297 |
| 4,612,608 | 9/1986 | Peitz | 362/346 X |

FOREIGN PATENT DOCUMENTS

| | | |
|---|---|---|
| 2726951 | 12/1977 | Fed. Rep. of Germany . |
| 3408718 | 9/1985 | Fed. Rep. of Germany . |
| 2104137 | 4/1972 | France . |

*Primary Examiner*—Stephen F. Husar
*Assistant Examiner*—Peggy Neils
*Attorney, Agent, or Firm*—Jenner & Block

[57] ABSTRACT

A lamp reflector comprises a dished body having a front opening and a rear aperture for a bulb having a filament. The dished body has an upper paraboloid reflective surface subtending an angle of about 165° at the optical axis. The body also has a lower paraboloidal reflective surface whose optical axis is coincident with. The filament lies on axis. The filament lies in front of the focus of the upper reflective portion but behind the focus of the lower reflective portion. The reflective portions and define an upwardly inclined step portion and a horizontally disposed step portion.

6 Claims, 2 Drawing Sheets

LAMP REFLECTOR

Figure 1:
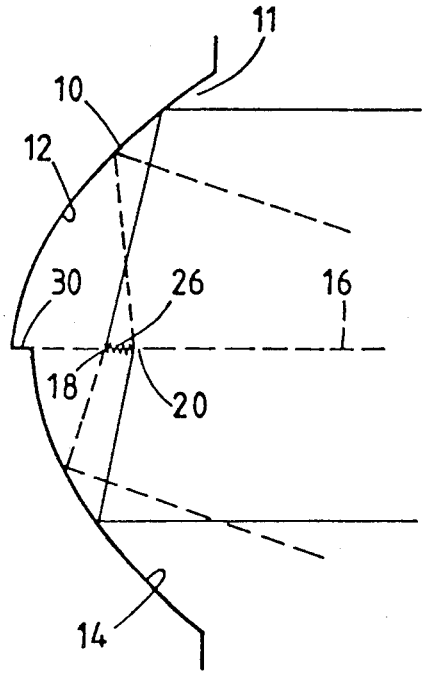
FIG. 1. PRIOR ART

This invention relates to a lamp reflector for use in a motor vehicle headlight unit.

Motor vehicle headlight units are subject to stringent regulations governing the permitted light pattern to optimise illumination of the road in front of a driver without dazzling oncoming drivers. In this respect, it is important to ensure that a headlight, when operated under so-called passing or dipped beam conditions, does not produce any light rays which are upwardly inclined in regions which are likely to dazzle oncoming drivers. Under ECE regulations, a beam pattern is permitted under passing beam conditions which is of the so-called asymmetric type. In such an asymmetric beam pattern, the top edge of the beam is sharply defined and comprises a horizontal portion which extends over the opposite side of the road and is horizontally disposed, and an inclined portion which extends over the nearside side of the road and the curb and extends upwardly at an angle of about 15° from the horizontal portion. The advantage of this type of asymmetric beam pattern is that illumination of the nearside of the road and the curb is enhanced without unduly increasing the risk of dazzling drivers in oncoming vehicles. In order to produce such a top edge to the beam pattern, it is common practice to provide an electric lamp having a filament fitted with a shield which prevents light from the filament from reaching those portions of the reflector which reflect light above the top edge. However, the disadvantage of this is that a very large portion of the reflector is never used under passing beam conditions, and this leads to a lower light output.

In order to overcome this disadvantage, it has been previously proposed to provide a lamp reflector comprising a dished body in which the reflective surface, instead of lying on a single paraboloidal surface, is split into a pair of upper and lower paraboloidal reflective surface portions which are so-mutually disposed that the focus of the lower reflective surface portion is spaced forwardly of the optical focus of the upper reflective surface portion. Such an arrangement of upper and lower surface reflective portions is disclosed, for example, in GB-A-972276, GB-A-997477, GB-A-1248445 and GB-A-1581135. The lamp filament is disposed between the two optical foci. The result of this is that, because of the positioning of the filament (which forms the light source) in front of the focus of the upper reflective surface portion, light reflected from the latter is convergent. In contrast, light reflected from the lower reflective surface portion is divergent because of the positioning of the filament behind the focal point of the lower reflective surface portion. In GB-A-997477 and GB-A-1581135, the upper and lower reflective surface portions are separated by laterally extending step regions of the dished body of which one of the step regions extends laterally horizontally whilst the other step region is inclined downwardly and laterally outwardly from the rear of the body, typically at an angle of 15° below the horizontal. Thus, the two step regions are so disposed that the upper reflective portion subtends an angle of approximately 195° about the longitudinal axis of the dished body. Because of the convergent effect produced by the upper reflective portion, the filament images are reversed so that the downwardly inclined step portion defines the inclined top edge portion of the beam, whilst the horizontal step region defines the horizontal top edge portion of the beam.

Particularly with modern compact designs of headlight unit where the reflective surface portions are of relatively short focal length, e.g. 20 to 28 mm, it is found that a relatively large proportion of the light passes through a relatively small region of the light transmitting outer cover which closes the front of the headlight unit. This concentration of light leads to the development of high temperatures in the front cover with the result that it is necessary to form the front cover out of material which has an adequate heat-resistance. Glass covers have to be subjected to a heat treatment to render them more resistant to heat, particularly when it is remembered that they may be subjected to a substantial quenching effect when hot by rain, spray or the like. The use of transparent plastics covers is also unsatisfactory because of the heating effect.

It is an object of the present invention to obviate or mitigate the above disadvantages by providing a lamp reflector in which there is a reduced concentration of light which can lead to localised overheating of the cover of the headlight unit.

According to the present invention, there is provided a lamp reflector comprising a dished body having a rear end, a front opening, a longitudinal axis extending through said front opening, and a pair of upper and lower reflective portions defined by respective surfaces of the body and separated by step regions extending on opposite sides of said longitudinal axis of the body, each of said upper and lower reflective surface portions having an optical focus which is located within the body, said optical focus of the upper reflective surface portion being spaced rearwardly of said optical focus of the lower reflective surface portion, characterised in that one of said step regions is inclined upwardly away from the region of the rear end and towards the front opening of the body.

The terms "rear", "front", "upper", "lower", "lateral" and "horizontal" are used in relation to the reflector when in the intended orientation for use on a motor vehicle.

Whilst the angle of the inclination of said one of said step regions may be 5° to 25° relative to said horizontal plane, it is preferably inclined at about 15°.

In a convenient embodiment, the optical foci are separated by a distance of about 7 mm so that a lamp filament having a length of about 5 mm can be disposed between and spaced from said foci.

Conveniently, the upper reflective surface portion is disposed on a surface whose apex or origin is spaced rearwardly of that of the surface on which the lower reflective surface portion lies whereby said step portions face upwardly. Such a construction has the advantage that any lacquer beads which are formed at the step portions as a result of a lacquering operation (which can be applied before and after metallising the body internally to produce the reflective surface) are of a shape which tend to cause light incident thereon to be refracted and reflected downwardly rather than upwardly.

Also according to the present invention there is provided a headlight unit comprising a reflector body according to said one aspect of the present invention, a transparent front cover overlying said front opening of said reflector body, and a lamp holder adapted to receive a lamp in use and to mount it so that a filament of the lamp is disposed between said optical foci of the upper and lower reflective surface portions of the reflector body.

Figure 2:
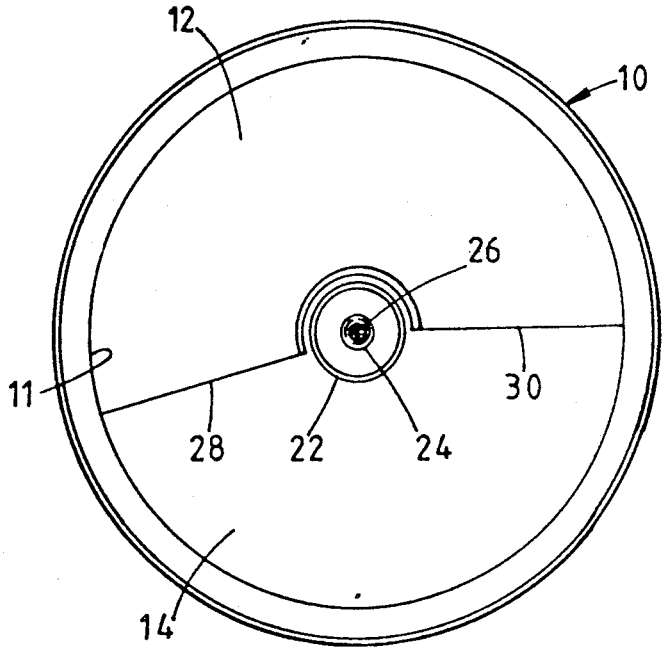
FIG. 2. PRIOR ART
Figure 3:
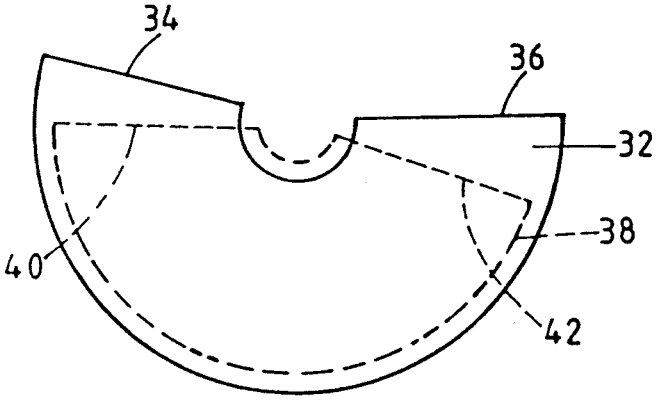
FIG. 3. PRIOR ART
Figure 4:
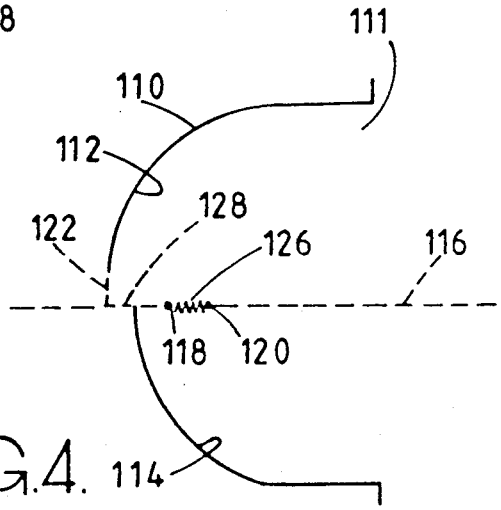
Figure 5:
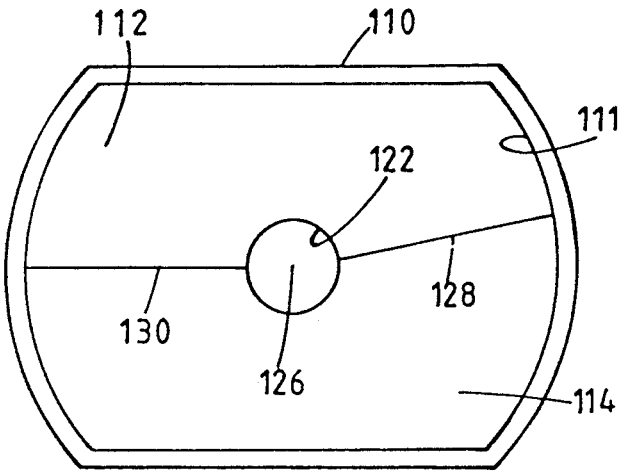
Figure 6:
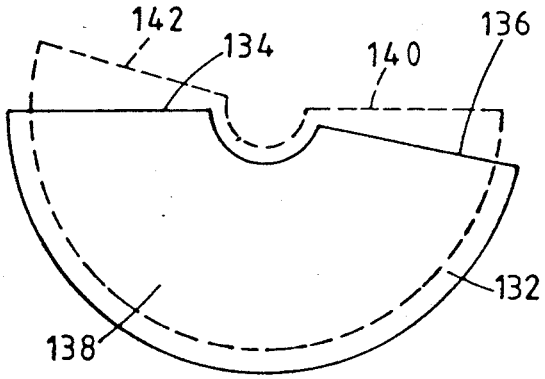
Figure 7:
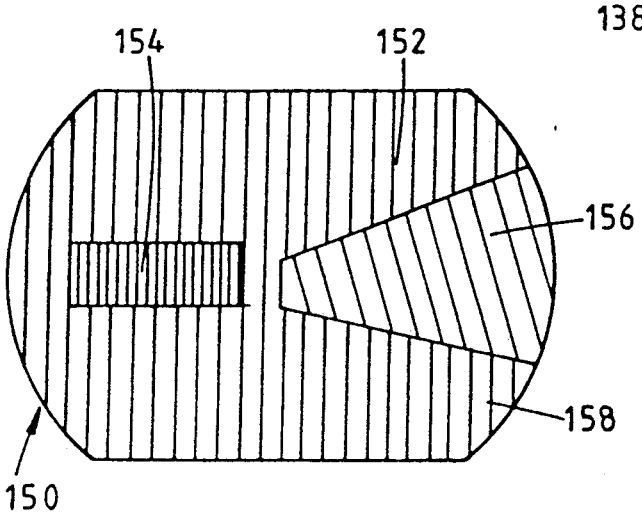
Figure 8:
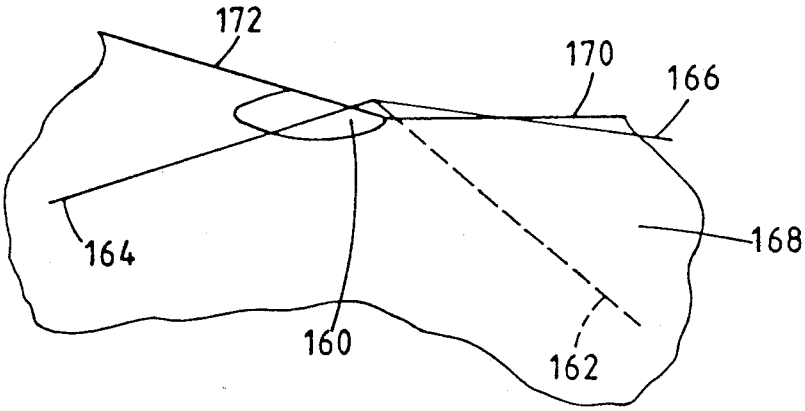

The present invention will now be described in further detail with reference to the accompanying drawings, in which:

FIGS. 1 and 2 are schematic side and front views, respectively, of a known lamp reflector according to GB-A-997477, FIG. 3 is a schematic illustration of the type of beam pattern produced by the lamp reflector of FIGS. 1 and 2, looking forwardly from behind the reflector, FIGS. 4 and 5 are schematic side and front views of a lamp reflector according to the present invention, FIG. 6 is a schematic view of the basic beam pattern produced by the lamp reflector of FIGS. 4 and 5, looking forwardly from behind the reflector, FIG. 7 is a front view of a headlight unit showing a transparent front cover overlying the lamp reflector of FIGS. 4 and 5, and FIG. 8 is a schematic representation showing the final beam pattern produced by the headlight assembly of FIG. 7 shown superimposed upon a schematic representation of a road.

Referring now to FIGS. 1 to 3 of the drawings, the known lamp reflector illustrated therein comprises a dished body 10 having a front opening 11 through which, in use, light passes. The dished body 10, which may be internally lacquered, is rendered reflective, preferably by means of a vacuum deposited aluminium film, followed by an optional lacquer coating to protect the reflective aluminium film from corrosion. The body 10 is internally shaped so as to provide upper and lower reflective surface portions 12 and 14 which lie on the surface of respective paraboloids. The paraboloids have their optical axes 16 coincident but are arranged so that the optical focus 18 of the upper reflective surface portion 12 is spaced behind the optical focus 20 of the lower reflective surface portion 14. The dished body 10 has a rear end provided with an aperture 22 which receives a lamp 24 (see FIG. 2). The lamp 24 has a filament 26 (see FIG. 1) which extends along the optical axis 16 between the foci 18 and 20. On opposite sides of the rear aperture 22 of the body 10, the upper and lower reflective surface portions 12 and 14 are separated by upwardly facing step regions 28 and 30, respectively. The step region 28 extends from adjacent the rear aperture 22 downwardly and outwardly towards the front opening 11 at an angle of 15° below the horizontal median plane of the body 10. As can be seen from FIG. 2, the step region 28 is disposed on the left of the rear aperture 22 when the reflector body 10 is viewed through the opening 11. The step region 30 extends in the horizontal median plane of the body 10 from adjacent the rear opening 22 horizontally outwardly to the front opening 11. Thus, the angle subtended by the upper reflective portion 12 at the axis 16 is 195°, whilst the angle subtended by the lower reflective portion 14 at the axis 16 is 165°.

Referring now to FIG. 3, the basic beam pattern produced by the reflector body of FIGS. 1 and 2 is illustrated therein. This basic beam pattern is as viewed from behind the reflector body 10 looking forwards. The pattern illustrated is that produced by the light which has reflected off the upper and lower reflective surface portions 10 and 14. The area 32 illustrated in full line in FIG. 3 corresponds to that produced by reflection off the upper reflective surface portion 10. In this respect, it will be appreciated that, because the lamp filament 26 is located forwardly of the optical focus 18 of the upper reflective surface portion 10, light reflected off the latter from the filament 26 will be convergent both horizontally and vertically, with the result that complete image inversion takes place. Thus, it is the step region 28 which defines a sharp upwardly inclined top edge region 34 at the left hand side of the area 32 as viewed in FIG. 3, whilst the step region 30 defines a horizontally extending top edge region 36 at the right hand side of the area 32 of FIG. 3. In contrast, image inversion does not occur as a result of reflection off the lower reflective surface portion 14 because the filament 26 is disposed behind the optical focus 20 of such portion 14. In this case, there is slight divergence of the reflected light to produce area 38 which is indicated in dotted line in FIG. 3. The horizontal and inclined upper regions 40 and 42 of this area 38 are defined, respectively, by the step regions 30 and 28.

In use, the lamp body illustrated in FIGS. 1 and 2 is provided with a glass cover (not shown) which overlies the front opening 11. In accordance with usual practice, the front cover is provided with a pattern of prisms and flutes (usually simply called "lensing") which serve (a) to refract those portions of the beam pattern 32 which lie just under the cut-off portions 34 and 36 inwardly to fill in the centre of the beam, and (b) to spread the light in the lower regions of both beam patterns 32 and 38 horizontally, so as to produce a beam pattern which is generally of the type schematically illustrated in FIG. 8 which will be described hereinafter. The convergent light which is reflected off the upper reflective surface portion 12 is concentrated towards the centre of the front cover and so produces a substantial heating effect therein which can lead to cracking of the front cover if it is not subjected to a special heat treatment process which increases the cost of production.

Referring now to FIGS. 4 and 5 of the drawings, an embodiment of lamp reflector according to the present invention is illustrated therein. For ease of description, parts of the lamp reflector of FIGS. 4 and 5 which are similar to those of FIGS. 1 and 2 are accorded the same reference numeral but in the 100 series. In FIGS. 4 and 5, the reflector body 110 has a quadrilateral front opening 111 as opposed to the circular front opening 11 illustrated in FIG. 2. However, it is within the scope of the present invention for the lamp reflector of the present invention to have a circular front opening. In this embodiment, upper reflective surface portion 112 subtends an angle of only 165° at longitudinal axis 126 of the body 110. It will also be seen that step region 130 which extends in the horizontal median plane of the body 110 is disposed on the opposite side of the body 110 to that on which the step region 30 is disposed in the case of the reflector body 10 of FIGS. 1 and 2. Step region 128 extends upwardly at an angle of about 15° to the horizontal median plane from adjacent the rear aperture 122 towards the front opening 111 on the right hand side of the body 110 as viewed in FIG. 5. It will therefore be appreciated that the angle subtended by the upper reflective surface portion 112 at the longitudinal axis of the body 110 is reduced by about 30° as compared with the upper reflective surface portion 12 of the body 10 of FIGS. 1 and 2. Thus, the total amount of convergent light is reduced which thereby also reduces the heating effect on transparent front cover 150 (see FIG. 7).

The basic beam pattern produced by the lamp reflector of FIGS. 4 and 5 is illustrated in FIG. 6 which is shown as viewed from behind the body 110 looking forwardly. Beam area 132 shown in full line in FIG. 6 corresponds to that produced by reflection of light from filament 126 off upper reflective surface portion 112, downwardly inclined top edge region 136 being defined by step region 128, and horizontal top edge region 134 being defined by step region 130. Beam area 138 illustrated in dotted line in FIG. 6 corresponds to that produced by reflection off lower reflective surface portion 114, with horizontal top edge region 140 being defined by step region 130 and upwardly inclined top edge region 142 being defined by step region 128. It will therefore be appreciated that, in the embodiment of FIGS. 4 and 5, the step region 128 which defines the upwardly inclined top edge region 142 in the basic beam pattern is provided on the opposite side of the lamp body to that which is the case in prior art constructions.

Referring now to FIG. 7, the transparent cover 150 which overlies the front opening 111 includes areas 152, 154, 156 and 158. The areas 152, 154, 156 and 158 are provided variously with prisms and fluting thereon which serve to refract light passing therethrough in the following manner. The areas 152 and 158 include fluting to spread the light passing therethrough horizontally, the area 154 is made up of prisms which refract the light horizontally towards the longitudinal axis 126, i.e. to the right as viewed in FIG. 7 so as to increase the intensity of light at a critical region 160 of the final beam pattern (see FIG. 8). The area 156 of the front cover 150 is made up of prisms which refract light inwardly and downwardly so as further to augment light in said region 160.

Referring now to FIG. 8, the final beam pattern produced by the light reflected off upper and lower reflective surface portions 110 and 114 and transmitted through the front cover 150 is illustrated schematically as superimposed upon a road where dotted line 162 represents the centre of the road, line 164 represents the near-side of the road, and line 166 represents the off-side of the road. The final beam pattern is not shown in full but the important central region thereof is shown by broken area 168 which is limited at the top by horizontal top edge portion 170 and upwardly inclined top edge portion 172 which meet on the centre line 162 of the road. The cut-off lines 170 and 172 are derived from respective lines 140 and 142 of FIG. 6. It is to be appreciated that the beam pattern illustrated in FIG. 8 is that produced solely by reflection off the surfaces 112 and 114 as modified by transmission through the cover 150. A so-called up-light shield (not shown) is disposed in front of the filament 126 in order to prevent light from passing through the cover 150 directly from the filament 126. This is in accordance with conventional headlamp technology.

In the above described embodiment, the reflective surface portions 112 and 114 lie on the surface of respective paraboloids so that the distance between the focal points 118 and 120 is 7 mm which is sufficient to accommodate filament 126 having a length of 5 mm so that the latter is equi-distantly spaced between the two foci 118 and 120. Additionally, the focal length of the paraboloid on which the upper reflective surface portion 110 is conveniently 27 mm, although it may have a focal length of between 20 and 35 mm. The focal length of the paraboloid on which the lower reflective surface portion lies is 24–30 mm.

In a modification (not shown), instead of each of the upper and lower reflective surface portions 112 and 114 lying on the surface of a respective paraboloid, one or each may lie on a surface produced by rotation of an ellipse about an axis which is inclined at a small angle (e.g. 1° to 2°) relative to the major axis of the ellipse and which intersects such axis at the inner focal point of the ellipse.

In a further modification (also not shown), the reflector body also includes at least one further reflective surface portion adjacent to the rear aperture 122. The or one of said further reflective surface portions may have a focal length which is different to that of the upper and lower reflective surface portions but which has an optical focus coincident with the focus 118 or 120.

What we claim is:

1. A lamp reflector comprising a dished body having a rear end, a front opening, a longitudinal axis extending through said front opening and a pair of upper and lower reflective portions defined by respective surfaces of the body and separated by step regions extending on opposite sides of said longitudinal axis of the body, said upper reflective surface portion subtending an angle of 155° to 175°, and each of said upper and lower reflective surface portions having an optical focus which is located within the body, said optical focus of the upper reflective surface portion being spaced rearwardly of said optical focus of the lower reflective surface portion characterized in that one of said step regions is inclined upwardly away from the region of the rear end and towards the front opening of the body.

2. A lamp reflector as claimed in claim 1, wherein the optical foci are separated by a distance of about 7 mm so that a lamp filament having a length of about 5 mm can be disposed between and spaced from said foci.

3. A lamp reflector as claimed in claim 1, wherein the upper reflective surface portion is disposed on a surface whose apex or origin is spaced rearwardly of that of the surface on which the lower reflective surface portion lies whereby said step portions face upwardly.

4. A headlight unit comprising:

(a) a lamp reflector including a dished body having a rear end, a front opening, a longitudinal axis extending through said front opening, a pair of upper and lower reflective portions defined by respective surfaces of the body and separated by step regions extending on opposite sides of said longitudinal axis of the body, said upper reflective surface portion subtending an angle of 155° to 175°, and each of said upper and lower reflective surface portions having an optical focus which is located within the body, said optical focus of the upper reflective surface portion being spaced rearwardly of said optical focus of the lower reflective surface portion;

(b) a transparent front cover overlying said front opening of said reflector body; and (c) a lamp holder adapted to receive a lamp in use and to mount it so that a filament of the lamp is disposed between said optical foci of the upper and lower reflective surface portions of the reflector body characterized in that one of said step regions is inclined upwardly away from the region of the rear end and towards the front opening of the body.

5. A headlight unit as claimed in claim 4, wherein the transparent front cover has an area which lies opposite said one of the step regions and which has prisms serving to refract reflected light passing therethrough downwardly and inwardly towards the longitudinal axis of the body.

6. A headlight unit as claimed in claim 5, wherein the transparent front cover has an area which lies opposite the other step region and which has prisms serving to refract light passing therethrough inwardly towards the longitudinal axis of the body.

* * * * *